US006312279B1

(12) United States Patent
Rachui et al.

(10) Patent No.: US 6,312,279 B1
(45) Date of Patent: Nov. 6, 2001

(54) MODULAR COMPONENT RECEIVING APPARATUS AND METHOD FOR INSTALLING MODULAR COMPONENTS

(75) Inventors: Roy Rachui, Georgetown; Robert C. Sloan, Round Rock; Mark Manley, Leander; Stephen Gill, Round Rock; Forrest Pobst, Austin, all of TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 09/519,697

(22) Filed: Mar. 7, 2000

(51) Int. Cl.[7] ..... H01R 13/64
(52) U.S. Cl. ..... 439/377; 439/327
(58) Field of Search ..... 439/377, 327, 439/328, 374, 64, 362, 359, 378

(56) References Cited

U.S. PATENT DOCUMENTS

| | | | | |
|---|---|---|---|---|
| 4,946,403 | | 8/1990 | Billman et al. . | |
| 5,026,297 | | 6/1991 | Krehbiel . | |
| 5,137,462 | * | 8/1992 | Casey et al. | 439/74 |
| 5,199,895 | | 4/1993 | Chang . | |
| 5,259,781 | * | 11/1993 | Baumberger et al. | 439/362 |
| 5,632,640 | | 5/1997 | Noda . | |
| 5,650,917 | * | 7/1997 | Hsu | 439/327 |
| 5,660,557 | * | 8/1997 | Lemke et al. | 439/328 |
| 5,863,213 | | 1/1999 | Enomoto et al. . | |
| 6,030,251 | * | 2/2000 | Stark et al. | 439/377 |
| 6,126,471 | * | 10/2000 | Yu et al. | 439/327 |

* cited by examiner

*Primary Examiner*—Brian Sircus
*Assistant Examiner*—Hae Moon Hyeon

(57) ABSTRACT

A modular component receiving structure (10) includes a guide structure (25) for guiding a modular component (12) into a proper installed position and for ensuring that the module is handled properly during installation. A drive arrangement including a threaded drive opening (32) may be included with the guide structure (25) for use in applying a proper installation force to move the memory module (12) into a proper installed position. The drive arrangement facilitates the use of a rotary tool to apply the installation force.

21 Claims, 4 Drawing Sheets

MODULAR COMPONENT RECEIVING APPARATUS AND METHOD FOR INSTALLING MODULAR COMPONENTS

TECHNICAL FIELD OF THE INVENTION

This invention relates to devices for receiving modular components and, more particularly, to devices and methods for installing modular electronic components in computer systems.

BACKGROUND OF THE INVENTION

Computer systems and other electronic systems use numerous modular components. These modular components can provide substantial flexibility in system configuration. This flexibility in system configuration allows manufacturers to adapt or customize a basic system design to meet the needs of a broad range of customers.

One common example of modular componentry used in digital computer systems is random access memory (RAM). The RAM found in personal computer systems or workstations commonly comprises one or more memory modules, each module having a circuit board or other substrate carrying one or more individually packaged memory circuit chips. These memory modules include an electrical contact arrangement positioned along one edge of the substrate. Each memory module is operatively connected to the computer system by inserting the contact arrangement edge of the module into a receptacle or connector associated with a module receiving arrangement mounted on the system motherboard.

Relatively low-end computers systems may include only a single, relatively low capacity memory module installed in the module receiving structure. Manufacturers may accommodate customers desiring more memory capacity by simply installing a higher capacity module in an available receiving structure or installing memory modules in each of the several receiving structures commonly provided on a system motherboard. A user may also readily switch out memory modules as desired to increase or decrease the RAM available in the system.

Numerous different types of modular component receiving structures have been developed for receiving the various types of modular components which may be used in electronic systems. A receiving structure for receiving an electronic modular component will include a receptacle or connector for receiving and making electrical contact with the various elements of a contact arrangement associated with the modular component. The modular component receiving structure will also generally include an arrangement for ensuring good electrical contact is maintained between the connector and module contact arrangement. This arrangement for ensuring good electrical contact may be integral with the receptacle or connector itself and/or may include separate locking arrangements for physically locking the modular component in a proper installed position.

A popular receiving structure for memory modules such as single in line memory modules (SIMMs) and dual in line memory modules (DIMMs), for example, includes an elongated base having a connector receptacle and a locking arrangement. A memory module is installed in this type of receiving structure by first aligning the contact arrangement edge of the module with the connector receptacle and then pressing the edge into the receptacle to an installed position in which electrodes within the connector make good electrical contact with the contact elements on the module. Once the module is pressed into the installed position, the locking members may be pivoted into contact with a feature on the module. This contact between the locking members and module physically retains the module in the installed position.

Although designs utilizing modular components are very popular with system manufacturers and users alike, there remain significant problems associated with the use of modular components. Properly installing a modular component requires a certain level of skill and training. For example, the proper amount of force must be applied to push the module into the receptacle. Applying too much force could damage the module or receiving structure, while applying insufficient force could leave the module improperly installed. Care must also be taken to handle the module properly and apply the installation force at the proper locations on the module. SIMMs and DIMMs are preferably handled by the ends of the module and the manually applied installation force is best applied at the ends of the module. Handling the memory module improperly or applying force at the wrong points could damage the module.

The skill required to install modular components in prior receiving structures is of particular concern to manufacturers. Perhaps the most immediate concern is the cost of training system assemblers. Costs resulting from improper modular component installation include the costs of technical support, costs associated with returns, and the loss of goodwill associated with system failures.

Another problem relating to the use of modular components involves physical security. Modular components are intended to be easily installed and removed. Unfortunately, the ease with which modular components made the removed from a system applies not only to the system owner or user, but also others who may be intent on absconding with a modular component installed in another's system.

SUMMARY OF THE INVENTION

It is an object of the invention to provide a modular component guide structure which overcomes the above-described problems and others associated with modular component receiving structures. The invention includes a complete modular component receiving structure, a guide for use with a prior art modular component receiving structure, and a computer system incorporating the new modular component receiving structure. The invention further encompasses a modular component installation method facilitated by the new receiving structure and guide structure.

These objects are accomplished with a modular component receiving structure which includes a special guide structure for guiding the modular component into a proper installed position and for ensuring that the module is handled properly during installation. Furthermore, a drive arrangement may be included with the guide structure for use in applying a proper installation force to move the memory module into a proper installed position. The drive arrangement facilitates the use of a rotary tool to apply the installation force. Using the rotary tool eliminates the manual application of force previously required to properly install modular components such as RAM modules in a computer system.

A modular component receiving structure according to the invention includes a connector for operatively connecting with a modular component in an installed position in the receiving structure. This connector may be similar to prior connectors used in modular component receiving structures. However, the present receiving structure further includes a guide structure having a guide opening aligned with the connector. The alignment between the guide opening and connector allows the modular component to extend through the guide opening and into proper contact with the connector when the modular component is moved to the installed position. An upper portion of the guide structure is adapted to cover a distal edge of the modular component when the component is in the installed position. However, access features associated with the guide structure leave proper contact points of the modular component exposed when the component is in the installed position. This covering or enclosure of the modular component distal edge, while leaving proper contact points exposed forces the installer to contact the module at the proper points while placing the module in the guide structure. Thus, the combination providing structure to cover the distal edge of the modular component while providing access to proper contact points on the component helps ensure that the modular component is properly handled during installation.

The drive arrangement according to the invention includes a drive opening positioned in the upper portion of the guide structure. This drive opening has a longitudinal axis extending generally perpendicular to the longitudinal dimension of the guide opening. The drive opening is also threaded about its longitudinal axis so that it may receive a receive a rotary drive element having a complementary thread.

To install a modular component into the receiving structure according to the invention, the module is first placed in an initial position in the guide opening. In this initial position, the edge of the modular component adapted to be received in the connector portion of the receiving structure lies adjacent to the connector in an aligned position. With the modular component in this initial position, the drive element is threaded into the threaded drive opening until an end of the drive element contacts the distal edge of the modular component. From this point, threading the drive element further into the drive opening applies an installation force between the guide structure and the modular component to press the component firmly into the proper installed position. Once pressed into the installed position a suitable locking arrangement included with the receiving structure may be moved into contact with the modular component to maintain the component in the installed position.

Although a modular component may be installed according to the invention by directly contacting the distal edge of the component with the drive element, the invention may also include an element for helping to protect the distal edge of the component. This edge protection element is adapted to be received in the drive opening after the modular component is placed in the initial position and prior to threading the drive element into the drive opening. The relatively soft, low friction material from which the edge protection element may be formed gently applies the desired installation force from the drive element to the modular component.

In some forms of the invention, the guide structure is incorporated into a complete modular component receiving structure. This embodiment is useful for use in new systems. Other forms of the invention may be used to retrofit prior art modular component receiving structures. In these alternate forms of the invention, the guide structure is provided with a mounting structure which allows the guide structure to be securely mounted on a prior art receiving structure having only a connector formed in a suitable base, and perhaps having a locking arrangement. With this form of the invention mounted on a prior art modular component receiving structure in an operating position, the guide opening is aligned with the prior art connector. The same upper guide structure portion, access features, and drive opening are incorporated into this alternate guide structure to provide the same benefits described above with reference to the complete modular component receiving structure.

These and other objects, advantages, and features of the invention will be apparent from the following description of the preferred embodiments, considered along with the accompanying drawings.

DESCRIPTION OF THE PREFERRED EMBODIMENTS

Figure 1:
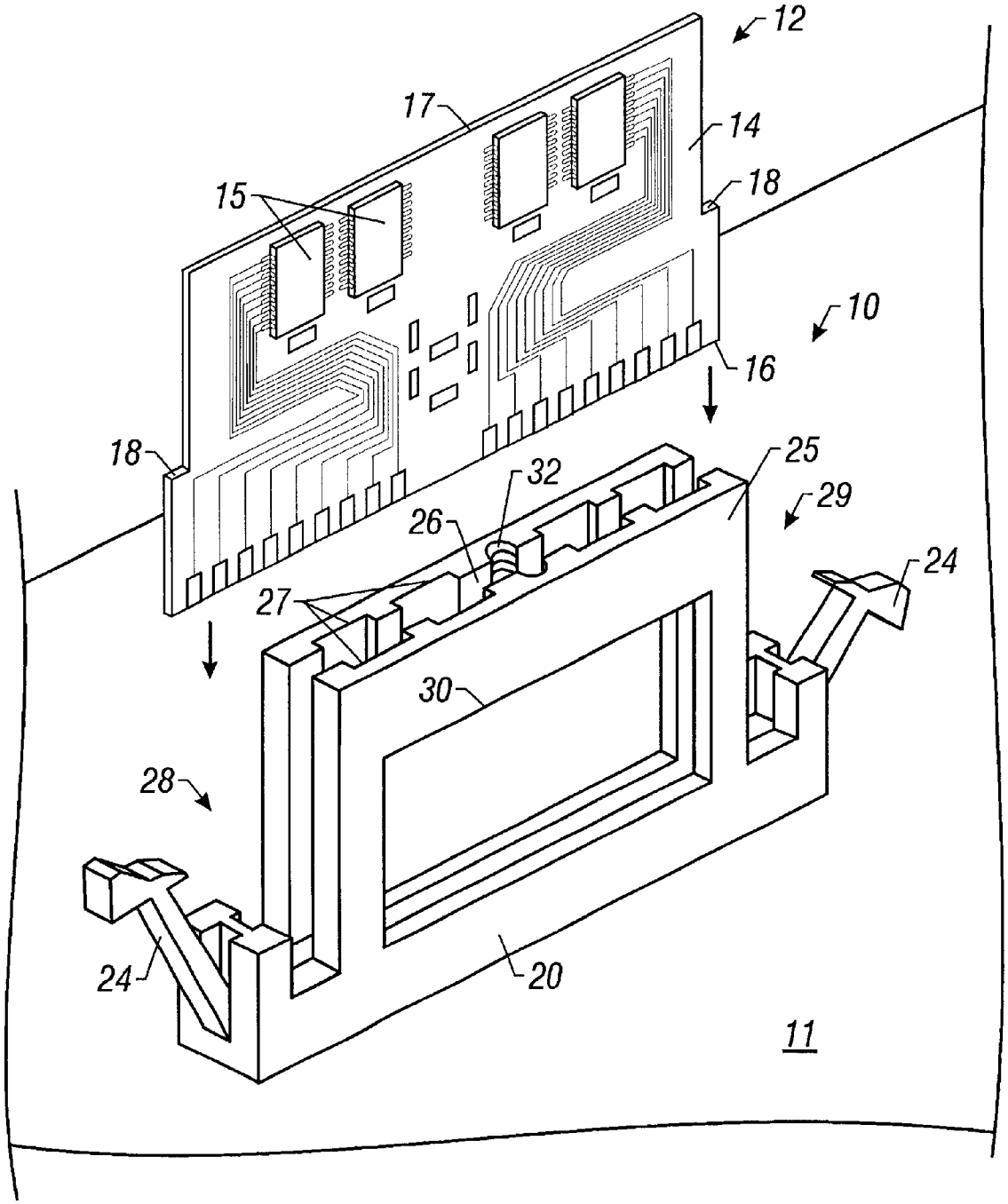
FIG. 1 is an exploded, partial isometric view showing a portion of a computer system having a modular component receiving structure embodying the principles of the invention, and further showing a modular component adapted to be received in the receiving structure.
Figure 2:
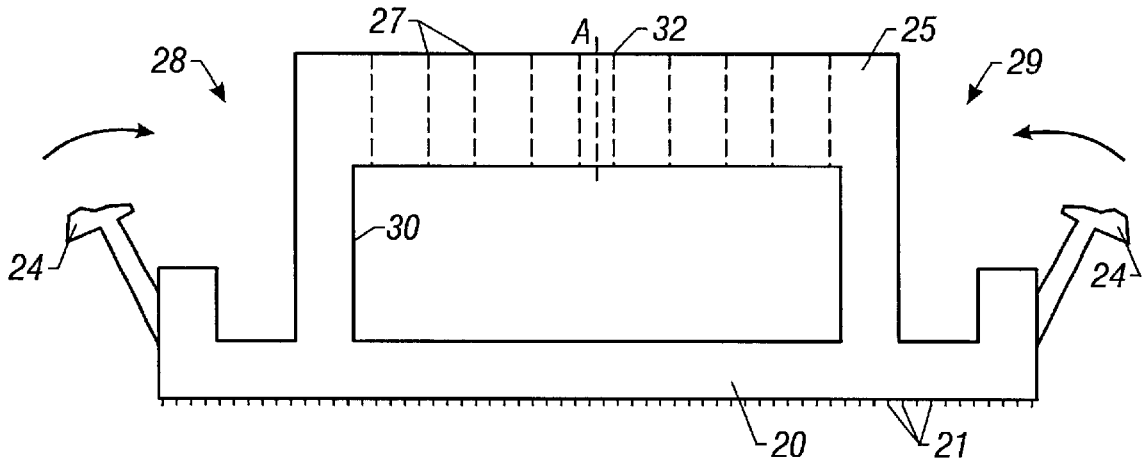
FIG. 2 is a side view of the receiving structure shown in FIG. 1.
Figure 3:
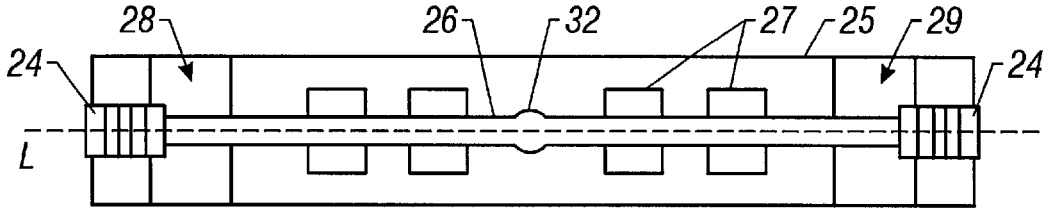
FIG. 3 is a top view of the receiving structure shown in FIG. 1.

Referring particularly to FIGS. 1 through 3, a modular component receiving apparatus or structure 10 is adapted to be mounted on a computer system motherboard 11 or similar structure. Receiving structure 10 is particularly adapted for use in receiving a memory module 12. Memory module 12 includes a suitable substrate 14 on which is mounted one or more individually packaged memory circuit chips 15. Module 12 also includes a lower edge 19 having a contact structure 16 for making electrical contact with receiving structure 10 as will be described below. Memory module 12 further includes an upper or the distal edge 17 and may further include shoulder features 18 which may be used to help retain the module in the desired installed position in receiving structure 10 as will be described below.

Although the invention is described with reference to a receiving structure adapted to receive and inline memory module such as memory module 12, it will be appreciated that a receiving structure according to invention is not limited to use with memory modules. Rather, the modular component receiving structure according to the invention may be used with substantially any other modular electronic components included in computer systems and other electronic systems.

Figure 5:
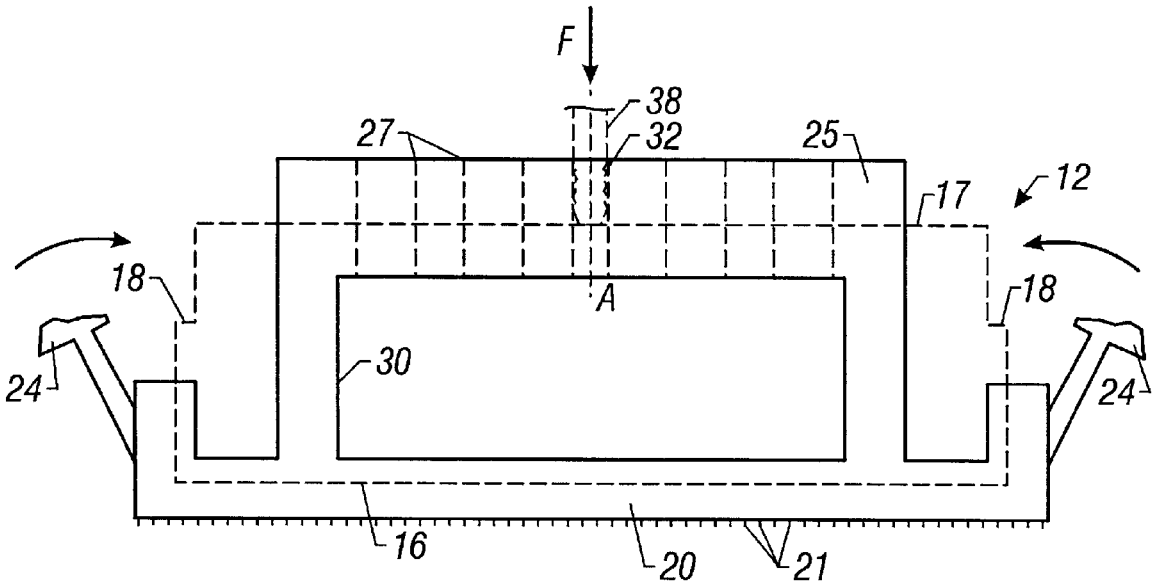
FIG. 5 is a view similar to FIG. 2, but showing the modular component in an installed position and also showing a drive element.

Receiving structure 10 includes a connector shown generally at reference numeral 20. Connector 20 is adapted to operatively connect with contact structure 16 on memory module 12 when the module is in an installed position in receiving structure 10. This installed position will be described below with particular reference to FIG. 5. In the illustrated form of the invention, connector 20 includes an elongated slot wide enough to receive the lower edge 19 of module 12. An electrode structure is included with in connector 20 for making electrical contact with the various contact elements formed on contact structure 16. These electronic elements of connector 20 are well-known in the field and are omitted from the drawings so as not to the obscure the invention in unnecessary detail. However, it will be appreciated that the electrodes within connector 20 lead to an arrangement of pins 21 on a lower surface of receiving structure 10, and that these pins are preferably used to mount the receiving structure 10 on system motherboard 11.

A locking arrangement is preferably associated with the lower portion of receiving structure 10. The illustrated locking arrangement includes two locking members 24. One locking member 24 is provided at each end of receiving structure 10. Each locking member 24 is adapted to pivot between an unlocked position shown in FIGS. 1 and 2 and a locked position shown in phantom in FIG. 2. As will be described below with reference to FIG. 5, each locking member 24 is adapted to make contact with one shoulder feature 18 on memory module 12 when the memory module is in the installed position and the respective locking member is pivoted to the locked position. This contact between the locking member 24 and shoulder feature 18 helps to retain memory module 12 securely in the installed position.

Referring to FIGS. 1 through 3, receiving structure 10 includes a guide structure 25 having a guide opening 26. Guide opening 26 is aligned with connector 20 so that module 12 may extend through the guide opening to connector 20. In order to accommodate chips 15 which extend from module 12, guide opening 26 may include insets 27. Also, one or more circulation openings 30 may be included in guide structure 25 to allow air to circulate freely over chips 15 when module 12 is in the installed position. An upper portion of the guide structure 25 is adapted to cover or enclose the distal edge 17 of memory module 12 when the module is in the installed position. By "covering" or "enclosing" distal edge 17 of module 12, it is meant that the upper portion of guide structure 25 lies adjacent to the distal edge, blocking access to the distal edge of the module. However, guide structure 25 also includes access features at both ends of the structure. The first access feature is shown generally at reference to 28 while a second access feature is shown generally at reference numeral 29. As shown particularly in FIGS. 4 and 5, access features 28 and 29 leave a portion of module 12 exposed when the module is received in both an initial position and the installed position.

Figure 6:
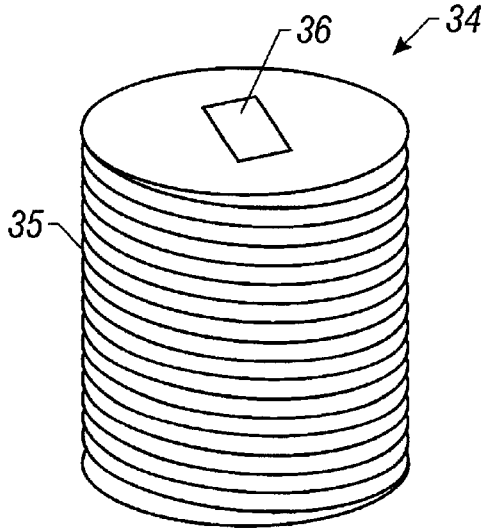
FIG. 6 is an isometric view of an edge protection element embodying the principles of the invention.

In the preferred form of the invention shown in FIGS. 1 through 5, the upper portion of guide structure 25 includes a drive opening 32. Drive opening 32 has a longitudinal axis A extending generally perpendicular to the longitudinal dimension L of guide opening 26. Also, drive opening 32 is threaded about its longitudinal axis L. An edge protection element 34 is shown in FIG. 6, and is adapted to the received within drive opening 32. Edge protection element 34 preferably includes an external thread 35 which is complementary to the thread of drive opening 32. A engagement feature 36 is included on one end of edge protection element 34 for use in removing the edge protection element from drive opening 32 as will be discussed below.

Receiving structure 10 and edge protection element 34 may be formed from any suitable material. Suitable materials for the guide structure portion of receiving structure 10 include various rigid plastics. Edge protection element 34 is preferably formed from a low friction plastic material such as nylon. Alternatively, edge protection element 34 may include a plastic lower tip or a lower tip and drive portion which may rotate with respect to the lower tip (not shown).

Figure 4:
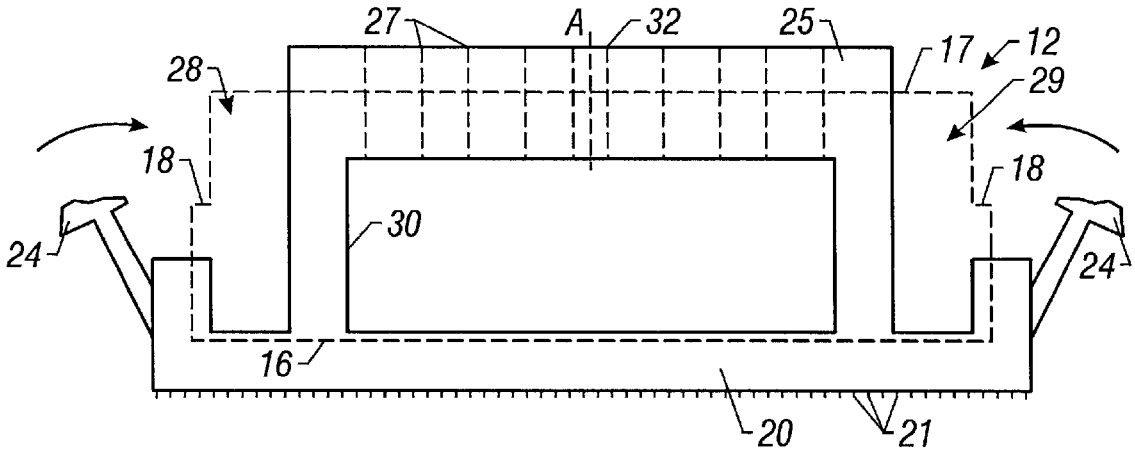
FIG. 4 is a side view similar to FIG. 2, but showing the modular component in an initial position.

Referring now particularly to FIG. 4, memory module 12 is adapted to be inserted into the guide opening 26 defined in guide structure 25. Memory module 12 is first inserted into an initial position in which contact structure 16 resides adjacent to connector 20. In this position, only the ends of memory module 12 are exposed. The bulk of distal edge 17 remains covered or enclosed in the upper portion of guide structure 25. Leaving the ends a module 12 exposed in this fashion encourages and practically requires that the installer hold the memory module by the ends while inserting the module into the initial position in guide opening 26. Thus, it is difficult for the installer to hold module 12 incorrectly while placing the module in the initial position.

From this initial position shown in FIG. 4, a drive element 38 (shown in phantom lines in FIG. 5 and having a thread complementary to the thread of drive opening 32) may be threaded into the drive opening until an end of drive element 38 contacts distal edge 17 of module 12. Once contact is made between drive element 38 and memory module 12, threading the drive element further causes the element to impart a downward force on module 12 generally in the direction shown at arrow F in FIG. 5. It will be noted that the force the installer applies to drive element 38 is a simple rotational force to thread the drive element into drive opening 32. The installer need not apply a downward force in direction F. The downward, installation force F on module 12 is generated as drive element 38 threads further into the threaded drive opening 32 and is actually applied from guide structure 25.

Alternatively to applying the installation force F directly from drive element 38 to distal edge 17 of module 12, the installation force may be applied indirectly through edge protection element 34 shown in FIG. 6. In this case, once module 12 is in the initial position as shown in FIG. 4, the installer inserts edge protection element 34 into drive opening 32 and then threads drive element 38 into the drive opening 32 above the edge protection element 34. Drive element 38 may then be threaded further into drive opening 32 to push or thread edge protection element 34 against distal edge 17 of module 12 and thus apply the installation force F to press module 12 into the installed position shown in FIG. 5. Where edge protection element 34 includes an unthreaded tip which may rotate with respect a threaded drive section, the installation force is applied without any rotating friction or wear against distal edge 17.

The preferred edge protection element 34 shown in FIG. 6 may be removed only with the aid of a special tool (not shown). In order to remove the illustrated edge protection element 34, a tool adapted to mate with engagement feature 36 is inserted into drive opening 32 and rotated in reverse to back the edge protection element out of the threaded drive opening. Once edge protection element 34 is removed, the installer may grasp module 12 by the ends exposed by access features 28 and 29, and then pull the module from the installed position.

Figure 7:
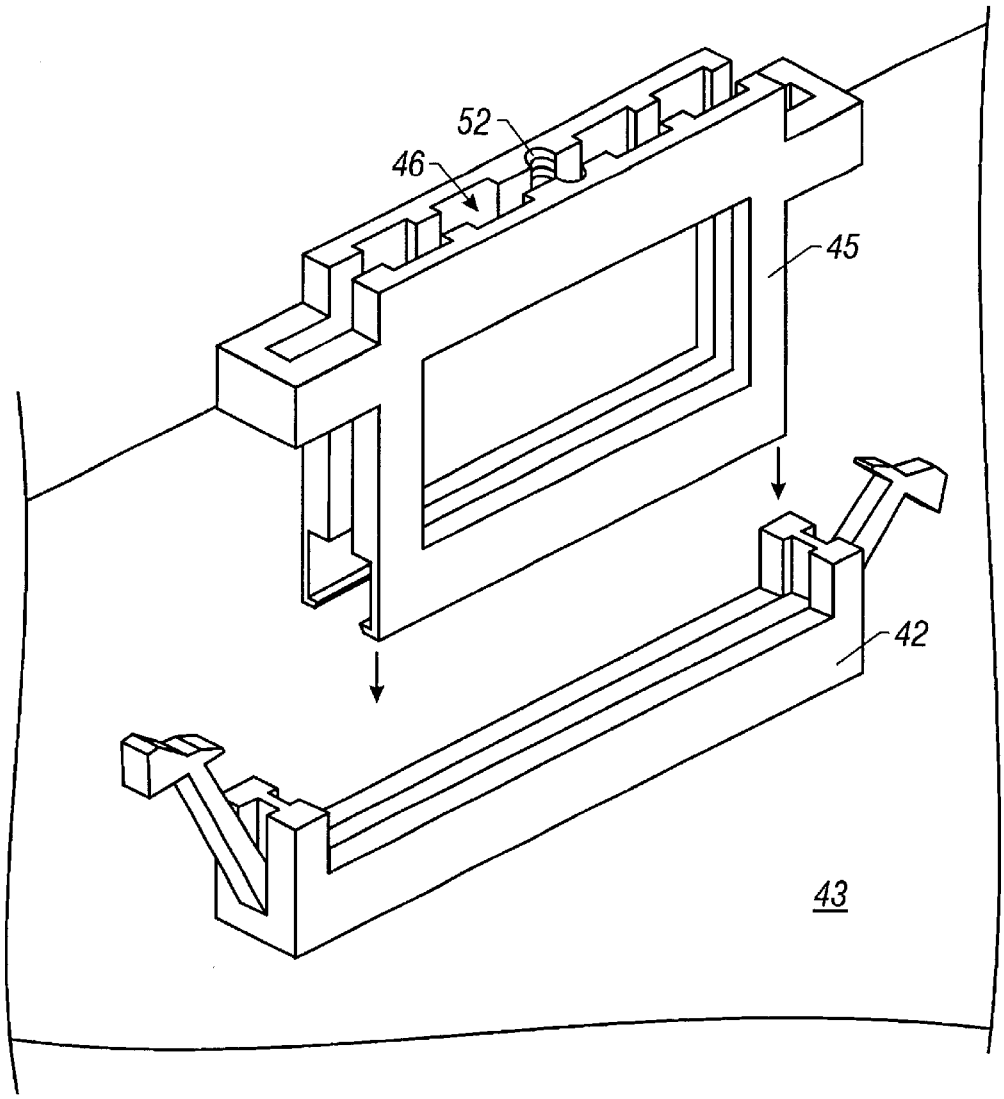
FIG. 7 is an in isometric view of an alternate form of the invention for use with a prior art modular component receiving arrangement.
Figure 8:
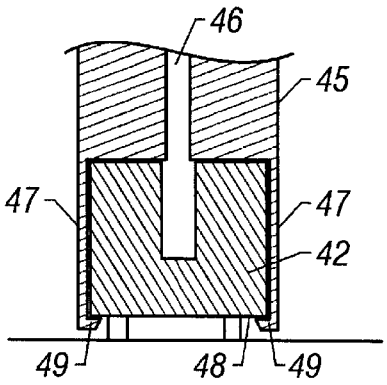
FIG. 8 is a partial section view taken along line 8—8 in FIG. 7 showing the alternate form of invention shown in FIG. 7 as connected in an operating position with a prior art modular component receiving arrangement.

FIGS. 7 and 8 show a form of the invention for use with a prior part modular component receiving structure. For purposes of example, this form of the invention is illustrated in connection with a prior art memory module socket 42 which has been installed on a system motherboard 43 as shown in FIG. 8. This form of the invention includes a guide structure 45 adapted to connect to the prior art socket structure 42 in an operating position shown in FIG. 8. In order to provide the desired connection, guide structure 45 includes lateral extensions 47 which are adapted to extend to a bottom edge 48 of socket structure 42. An angled feature 49 at the bottom of each lateral extension 47 snaps over bottom edge 48 and provides a secure connection between guide structure 45 and prior art socket structure 42.

As in the form of the invention shown in FIGS. 1 through 5, guide structure 45 includes a guide opening 46. This guide opening 46 is oriented in guide structure 45 so as to align with socket 42 when the guide structure is in the operating position shown in FIG. 8. The upper portion of guide structure 45 corresponds to the upper portion shown in FIGS. 1 through 5. The length of guide structure 45 is relatively shorter than the length of socket 42. This leaves the ends of a memory module received in the structure 45 exposed similarly to the areas of the module 12 exposed by access features 28 and 29 shown in FIGS. 2, 4, and 5 and described above.

The alternative guide structure 45 shown in FIGS. 7 and 8 also includes a drive opening 52 corresponding to the drive opening 32 shown in FIGS. 1 through 5. Drive opening 52 is threaded as previously described with reference to drive opening 32 and provides the identical function as that previously described drive opening. Edge protection elements such has the edge protection element 34 shown in FIG. 6 may be used with the form of invention shown FIGS. 7 and 8.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A modular component receiving apparatus comprising:

(a) a connector for operatively connecting with a modular component when the modular component is in an installed position in the receiving apparatus;

(b) a guide structure having a guide opening aligned with the connector so that the modular component may extend through the guide opening to the connector when the modular component is in the installed position;

(c) an upper portion of the guide structure, the upper portion of the guide structure covering a distal edge of the modular component when the modular component is in the installed position; and (d) a first access feature at a first end of the guide structure and a second access feature at a second end of the guide structure, each access feature leaving a different end portion of the modular component exposed when the modular component is received in the guide opening in the installed position.

2. The apparatus of claim 1 further comprising:

(a) a drive opening positioned in the guide structure upper portion, the drive opening having a longitudinal axis extending generally perpendicular to a longitudinal dimension of the guide opening and being threaded about said longitudinal axis.

3. The apparatus of claim 2 further comprising:

(a) an edge protection element received within the drive opening.

4. The apparatus of claim 3 wherein:

(a) the edge protection element includes a threaded portion having a thread which is complementary to the thread of the drive opening; and (b) the edge protection element further includes an engagement feature through which a rotational force may be imparted to the edge protection element when the edge protection element is threaded into the drive opening.

5. The apparatus of claim 1 further comprising:

(a) a locking arrangement for locking the modular component in the installed position.

6. The apparatus of claim 5 further comprising:

(a) two locking members, each locking member located adjacent to a different one of the first and second access areas and pivotable between an unlocked position and a locked position, each respective locking member for contacting a different feature of the modular component when the modular component is in the installed position and the respective locking member is moved to the locked position.

7. The apparatus of claim 1 further including:

(a) at least one circulation opening in the guide structure, each circulation opening extending from an exterior surface of the guide structure to the area defined by the guide opening to allow air circulation adjacent to a surface of the modular component.

8. An electronic module installation guide apparatus for use with a receiving structure having a receptacle for receiving an electronic module in an installed position, the installation guide comprising:

(a) a guide structure for connecting to the receiving arrangement in an operating position;

(b) a guide opening included in the guide structure, the guide opening oriented in the guide structure so as to align with the receiving structure receptacle when the guide structure is in the operating position;

(c) an upper portion of the guide structure, the upper portion of the guide structure covering a distal edge of the electronic module when the guide structure is in the operating position and the electronic module is in the installed position; and (d) a first access feature at a first end of the elongated guide structure and a second access feature at a second end of the elongated guide structure, each access feature leaving an end portion of the electronic module exposed when the guide structure is in the operating position and the electronic module is in the installed position.

9. The apparatus of claim 8 further including:

(a) at least one circulation opening in the guide structure, each circulation opening extending from an exterior surface of the guide structure into the area defined by the guide opening.

10. The apparatus of claim 8 further comprising:

(a) a drive opening located at the upper portion of the guide structure, the drive opening having a longitudinal axis extending generally perpendicular to a longitudinal dimension of the guide opening and being threaded about said longitudinal axis.

11. The apparatus of claim 10 further comprising:

(a) an edge protection element received within the drive opening.

12. The apparatus of claim 11 wherein:

(a) the edge protection element includes a threaded portion having a thread which is complementary to the thread of the drive opening; and (b) the edge protection element further includes an engagement feature through which a rotational force may be imparted to the edge protection element when the edge protection element is threaded into the drive opening.

13. A computer system having at least one modular component receiving structure, the modular component receiving structure comprising:

(a) a connector for operatively connecting with a modular component when the modular component is in an installed position in the receiving structure;

(b) a guide structure having a guide opening aligned with the connector so that the modular component may extend through the guide opening to the connector when the modular component is in the installed position;

(c) an upper portion of the guide structure covering a distal edge of the modular component when the modular component is in the installed position; and (d) a first access feature at a first end of the guide structure and a second access feature at a second end of the guide structure, each access feature leaving a different end portion of the modular component exposed when the modular component is received in the guide opening in the installed position.

14. The computer system of claim 13 further comprising:

(a) a drive opening positioned in the guide structure upper portion, the drive opening having a longitudinal axis extending generally perpendicular to a longitudinal dimension of the guide opening and being threaded about said longitudinal axis.

15. The computer system of claim 14 further comprising:

(a) an edge protection element including a threaded portion having a thread which is complementary to the thread of the drive opening; and (b) an engagement feature associated with the edge protection element through which a rotational force may be imparted to the edge protection element when the edge protection element is threaded into the drive opening.

16. The computer system of claim 13 further comprising:

(a) a locking arrangement for locking the modular component in the installed position.

17. The computer system of claim 16 further comprising:

(a) two locking members, each locking member located adjacent to a different one of the first and second access areas and pivotable between an unlocked position and a locked position, each respective locking member for contacting a different feature of the modular component when the modular component is in the installed position and the respective locking member is moved to the locked position.

18. The computer system of claim 13 further including:

(a) at least one circulation opening in the guide structure, each circulation opening extending from an exterior surface of the guide structure to the area defined by the guide opening to allow air circulation adjacent to a surface of the modular component.

19. A method of installing an electronic module in an electronic module receiving structure, the method comprising the steps of:

(a) placing an electronic module in an initial position in a guide opening aligned with a connector of the electronic module receiving structure, a contact structure of the electronic module aligned with and residing adjacent to the connector when the electronic module is in the initial position;

(b) with the electronic module in the initial position, applying an installation force from an upper portion of the electronic module receiving structure to a distal edge of the electronic module, the installation force being perpendicular to a plane of the connector and being applied in a direction from the upper portion of the electronic module receiving structure toward the connector.

20. The method of claim 19 wherein the step of applying the installation force includes:

(a) threading a drive member into a drive opening formed in the upper portion of the electronic module receiving structure.

21. The method of claim 20 further comprising the step of:

(a) inserting an edge protection element into the drive opening prior to threading the drive member into the drive opening so that the installation force is applied to the electronic module through the edge protection element.

* * * * *